US009163882B2

(12) United States Patent
Crawford

(10) Patent No.: US 9,163,882 B2
(45) Date of Patent: Oct. 20, 2015

(54) PLATE HEAT EXCHANGER WITH CHANNELS FOR 'LEAKING FLUID'

(75) Inventor: Gary A. Crawford, East Amherst, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 634 days.

(21) Appl. No.: 13/093,161

(22) Filed: Apr. 25, 2011

(65) Prior Publication Data

US 2012/0267084 A1 Oct. 25, 2012

(51) Int. Cl.

| | |
|---|---|
| ***F28F 3/08*** | (2006.01) |
| ***F28D 9/00*** | (2006.01) |
| ***F28F 3/00*** | (2006.01) |

(52) U.S. Cl.

CPC ..... *F28D 9/005* (2013.01); *F28F 3/005* (2013.01); *F28F 2265/16* (2013.01)

(58) Field of Classification Search

CPC ..... F28D 9/005; F28F 2265/16; F28F 3/005
USPC ..... 165/70, 71, 109.1, 164, 165, 166, 167
See application file for complete search history.

(56) References Cited

U.S. PATENT DOCUMENTS

| | | | | |
|---|---|---|---|---|
| 2,193,405 | A | 3/1940 | Goodman | |
| 2,248,933 | A | 7/1941 | Astle | |
| 3,825,061 | A | 7/1974 | Bathla | |
| 4,249,597 | A | 2/1981 | Carey | |
| 4,372,375 | A * | 2/1983 | Bond | 165/70 |
| 4,607,684 | A | 8/1986 | Wiard | |
| 4,635,711 | A | 1/1987 | Clark, Jr. | |
| 4,678,027 | A | 7/1987 | Shirey | |
| 4,903,758 | A | 2/1990 | Cowan | |
| 4,976,313 | A | 12/1990 | Dahlgren | |
| 4,987,955 | A | 1/1991 | Bergqvist | |
| 5,178,207 | A * | 1/1993 | Bergqvist et al. | 165/70 |
| 5,193,602 | A | 3/1993 | Morales | |
| 5,222,551 | A | 6/1993 | Hasegawa | |

(Continued)

FOREIGN PATENT DOCUMENTS

| | | |
|---|---|---|
| DE | 4207761 A1 | 9/1992 |
| JP | 2002-107089 | 4/2002 |

(Continued)

OTHER PUBLICATIONS

English Translation of JP 2002107089; Published in 2002; Inventor Kataoka.*

(Continued)

*Primary Examiner* — Marc Norman
*Assistant Examiner* — Max Snow
(74) *Attorney, Agent, or Firm* — RatnerPrestia

(57) ABSTRACT

A double-wall heat exchanger includes a plurality of heat exchange plate pairs. Each heat exchange plate pair forms a double-wall structure including two heat exchange plates that are at least partially separated by a leak space. At least one weep hole is disposed through the plurality of heat exchange plate pairs and intersects the leak spaces of the plurality of plate pairs to channel leaking fluid from the leak spaces to a location outside of the heat exchanger. The at least one weep hole is positioned on a surface of the heat exchanger at a location that is spaced from a side boundary of the heat exchanger thereby enabling an operator of the heat exchanger to observe a leakage on the surface of the heat exchanger.

11 Claims, 8 Drawing Sheets

(56) References Cited

U.S. PATENT DOCUMENTS

| | | | | |
|---|---|---|---|---|
| 5,291,945 | A | 3/1994 | Blomgren | |
| 5,435,383 | A | 7/1995 | Rajagopal | |
| 5,443,115 | A | 8/1995 | Pedersen | |
| 5,487,424 | A | 1/1996 | Davison | |
| 5,913,361 | A * | 6/1999 | Engstrom et al. | 165/70 |
| 5,924,484 | A | 7/1999 | Andersson | |
| 5,931,224 | A | 8/1999 | Chevallier | |
| 6,401,804 | B1 | 6/2002 | Shimoya | |
| 6,662,862 | B1 | 12/2003 | Lindholm | |
| 6,911,631 | B2 | 6/2005 | Nilsson | |
| 6,973,961 | B2 | 12/2005 | Rehberg | |
| 7,032,654 | B2 | 4/2006 | Wand | |
| 7,204,297 | B2 * | 4/2007 | Rehberg | 165/70 |
| 7,337,836 | B1 * | 3/2008 | Persson | 165/167 |
| 7,870,671 | B2 | 1/2011 | Rissler | |
| 2003/0102107 | A1 | 6/2003 | Nilsson | |
| 2004/0200607 | A1 | 10/2004 | Rehberg | |
| 2006/0225283 | A1 | 10/2006 | Rissler | |
| 2007/0169916 | A1 | 7/2007 | Wand | |
| 2010/0300651 | A1 | 12/2010 | Kumar | |

FOREIGN PATENT DOCUMENTS

| | | |
|---|---|---|
| WO | WO 86/06463 | 11/1986 |
| WO | 9117404 | 11/1991 |
| WO | WO 96/41995 | 12/1996 |
| WO | 0116544 | 3/2001 |
| WO | 2005009669 | 2/2005 |

OTHER PUBLICATIONS

International Search Report corresponding to International Application No. PCT/US2012/034923, dated Jul. 17, 2012.

Notification Concerning Transmittal of International Preliminary Report on Patentability relating to International Application No. PCT/US2012/034923, dated Nov. 7, 2013.

* cited by examiner

PLATE HEAT EXCHANGER WITH CHANNELS FOR 'LEAKING FLUID'

TECHNICAL FIELD

The present invention relates to a double-wall, vented heat exchanger.

BACKGROUND OF THE INVENTION

Heat exchangers are traditionally used to heat or cool potable or process critical fluids using non-potable fluids while providing a physical, mechanical boundary to prevent contact between the respective fluid streams.

Heat exchangers, as with all mechanical devices, have finite operating timeframes at the end of which the devices fail for one or more reasons. One typical failure mode for heat exchangers is an external leak in which one or both fluids escape to the outside environment or atmosphere. Another typical failure mode for heat exchangers is an internal leak in which one or both fluids mix with one another without escaping to the outside environment. Internal leaks are not observable from the exterior of the heat exchanger, whereas external leaks may be visually evident.

To avoid an internal leak, which may not be readily observed by an operator of a single-wall heat exchanger, it is desirable to provide a vented, double-wall boundary that exhausts the leaking fluid to the outside environment or atmosphere in lieu of having the respective fluids mix inside the heat exchanger while the heat exchanger continues to operate. A double-wall heat exchanger is one in which the boundary separating the two fluids is comprised of two separate surface layers, rather than one. Thus, if the first surface layer fails to provide a fluid tight barrier, the second layer should remain intact, causing the leaking fluid to flow between the surface layers to a location where the leaking fluid can be detected externally of the heat exchanger. The double-wall construction is intended to be a safety feature to prevent cross-contamination of the fluids. A double-wall heat exchanger is disclosed for example, in U.S. Patent Application Publication No. 2007/0169916 to Wand, which is incorporated by reference herein in its entirety.

The double-wall heat exchanger disclosed in Pub. '916 to Wand is vented, i.e., it includes an aperture that channels internal leaks to an exterior surface of the heat exchanger. The aperture is defined on the boundary edge of the heat exchanger. Any leakage that forms on the boundary edge of the heat exchanger may be difficult to observe. In view of the foregoing, it is preferable to direct the leaking fluid to a location on the heat exchanger where the leaking fluid can be readily detected so that the faulty heat exchanger can be removed from service.

SUMMARY OF THE INVENTION

According to one aspect of the invention, a double-wall heat exchanger includes a plurality of heat exchange plate pairs. Each heat exchange plate pair forms a double-wall structure including two heat exchange plates that are at least partially separated by a leak space. At least one weep hole is disposed through the plurality of heat exchange plate pairs and intersects the leak spaces of the plurality of plate pairs to channel leaking fluid from the leak spaces to a location outside of the heat exchanger. The at least one weep hole is positioned on a surface of the heat exchanger at a location that is spaced from a side boundary of the heat exchanger thereby enabling an operator of the heat exchanger to observe a leakage on the surface of the heat exchanger.

According to another aspect of the invention, a double-wall heat exchanger includes a plurality of heat exchange plate pairs. Each heat exchange plate pair forms a double-wall structure comprising two heat exchange plates that are at least partially separated by a leak space. At least one fluid port is defined on each plate pair through which a heat exchange fluid is distributed either into or out of a fluid channel that is defined between two adjacent plate pairs. Two adjacent plate pairs are mated together at a boundary of the at least one fluid port. A port vent groove is defined between the two adjacent plate pairs at a location surrounding the at least one fluid port. The port vent groove intersects and is in fluid communication with a leak space of one of the two adjacent plate pairs. At least one weep hole is disposed through the plurality of heat exchange plate pairs and intersects the leak spaces of the plurality of plate pairs to channel leaking fluid within one of the leak spaces or the port vent groove to a location outside of the heat exchanger.

BRIEF DESCRIPTION OF THE FIGURES

The invention is best understood from the following detailed description when read in connection with the accompanying drawing. Included in the drawing are the following figures.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention. In the figures, like item numbers are used to refer to like elements.

Figure 1:
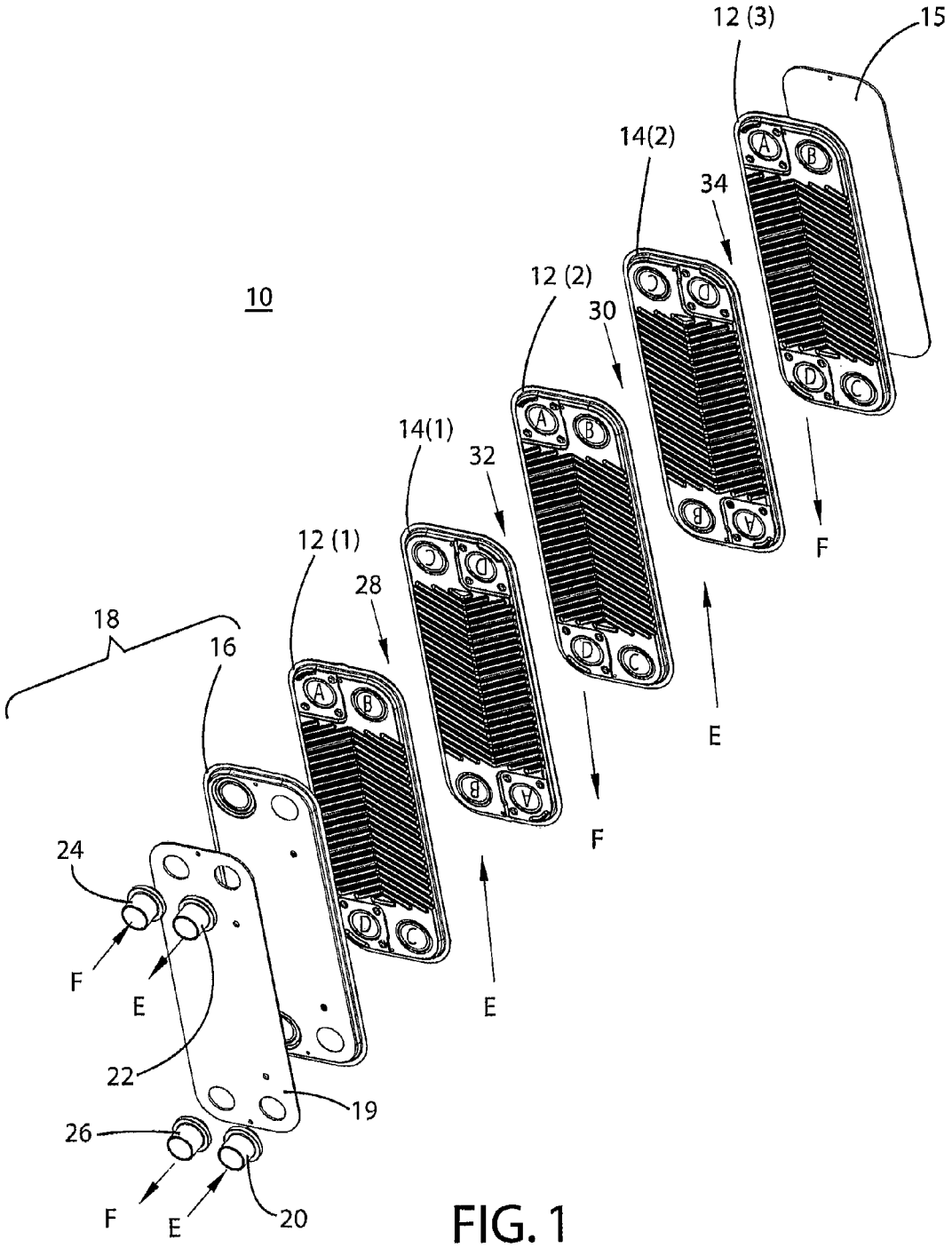
FIG. 1 depicts an exploded perspective view of a double-wall, vented heat exchanger, according to an exemplary embodiment of the invention.

FIG. 1 depicts an exploded perspective view of a double-wall, vented heat exchanger, according to an exemplary embodiment of the invention, which is denoted by numeral '10.' The heat exchanger 10 comprises a series of stacked double-walled heat transfer plate pairs 12(1), 14(1), 12(2), 14(2) and 12(3). Heat transfer plate pairs 12(1), 12(2), 12(3), which are structurally equivalent, are referred to collectively as plate pairs 12. Heat transfer plate pairs 14(1) and 14(2), which are also structurally equivalent, are referred to collectively as plate pairs 14. Heat transfer plate pairs 12 and 14 are structurally equivalent, however, plate pairs 14 are rotated by approximately 180 degrees with respect to plate pairs 12 (note the orientation of ports A-D) in FIG. 1.

Each heat transfer plate pair 14 is sandwiched between two heat transfer plate pairs 12, and each plate pair 12 is positioned against at least one plate pair 14. The stack of plate pairs 12 and 14 are sandwiched between a rear plate 15 and a faceplate assembly 18. The faceplate assembly 18 includes a seal plate 16, a faceplate 19 and a series of fluid connectors 20, 22, 24 and 26, which are fixedly mounted through ports defined on the interior plate 16 and the faceplate 19. The seal plate 16 is an optional component of the faceplate assembly 18. The fluid connectors 20, 22, 24 and 26 are configured to distribute fluid either into or out of the internal flow channels of the heat exchanger 10, as described hereinafter.

The plate pairs 12 and 14 are stacked and brazed together to create two discrete and isolated fluid flow passageways 'E' and 'F'. The fluid flow passageway 'E' is defined by the fluid connector 20, the flow channel 28 that is defined between plate pairs 12(1) and 14(1), the flow channel 30 that is defined between plate pairs 12(2) and 14(2), and the fluid connector 22. The fluid flow passageway 'F' is defined by the fluid connector 24, the flow channel 32 that is defined between plate pairs 14(1) and 12(2), the flow channel 34 that is defined between plate pairs 14(2) and 12(3), and the fluid connector 26.

Figure 5:
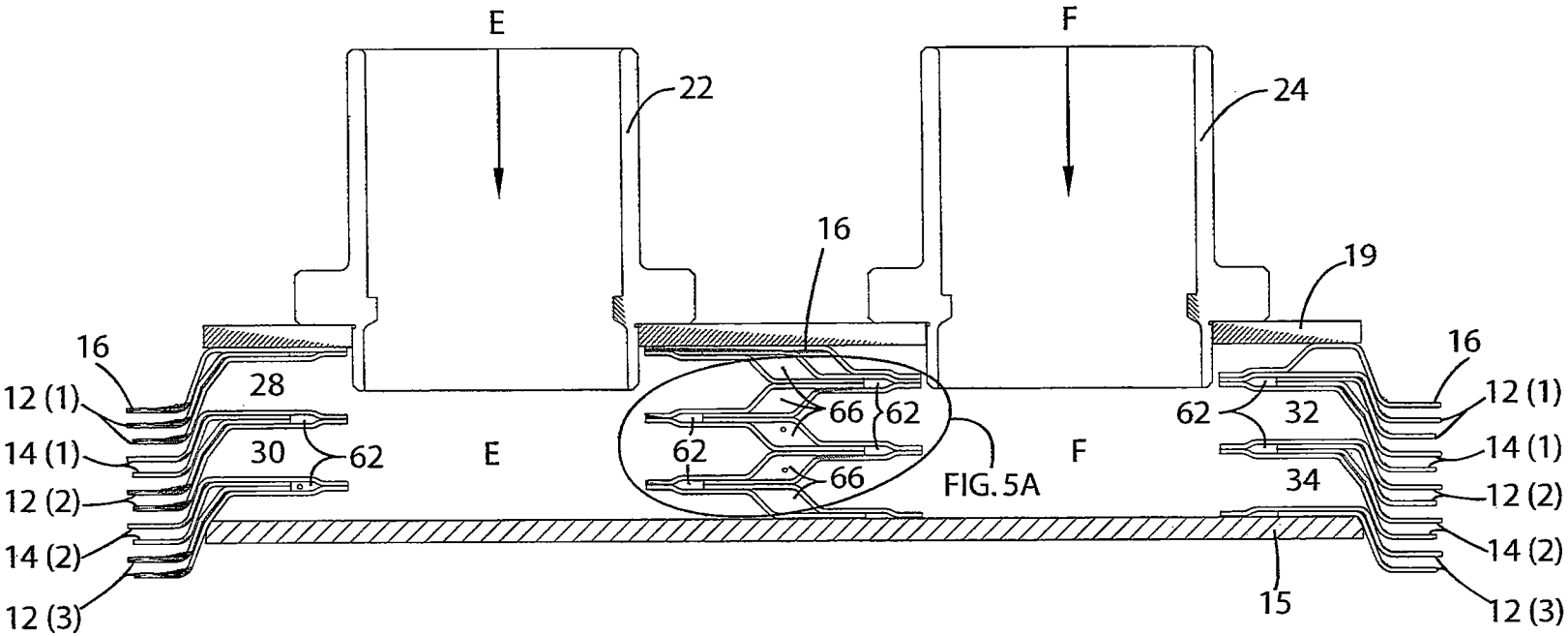
FIG. 5 depicts a cross-sectional side elevation view of the heat exchanger of FIG. 3 taken along the lines 5-5 and rotated 90 degrees counterclockwise.

Referring now to FIGS. 1 and 5, in operation, separate fluid streams are distributed through the discrete fluid flow passageways 'E' and 'F' of the heat exchanger 10 to exchange thermal energy with each other. One fluid stream is delivered through the connector 20 of the flow passageway 'E', directed through the two fluid flow channels 28 and 30 of the flow passageway 'E', and expelled out of the heat exchanger 10 through the fluid connector 22 of the flow passageway 'E'. Another fluid stream is delivered through the fluid connector 24 of the flow passageway 'F', directed through the two fluid flow channels 32 and 34 of the flow passageway 'F', and expelled out of the heat exchanger 10 through the fluid connector 26 of the flow passageway 'F'.

Those skilled in the art will recognize that the position of the fluid connectors 20, 22, 24 and 26 may vary from that shown and described without altering the operation of the heat exchanger 10. As one alternative, the fluid connectors 20, 22, 24 and 26 may be positioned on the rear plate 15. As another alternative, some of the fluid connectors 20, 22, 24 and 26 may be positioned on the faceplate 19 while the remaining fluid connectors 20, 22, 24 and 26 are positioned on the rear plate 15. For example, the fluid connectors 20, 24 and 26 can be positioned on the faceplate 19 (as shown) while the fluid connector 22 is positioned on the rear plate 15 at either port 'B' or port 'C' of the plate pair 12(3) without significantly altering the operation of the heat exchanger 10. In that example, a fluid stream is delivered through the connector 20 on the faceplate 19, directed through the two fluid flow channels 28 and 30 of the flow passageway 'E', and expelled out of the heat exchanger 10 through the fluid connector 22 on the rear plate 15.

Referring back to FIGS. 1 and 5, the brazings between the plates of the plate pairs 12 and 14 prevent the fluid streams within adjacent fluid flow passageways E and F from combining together (see FIG. 5). In other words, by virtue of the brazings, the flow channel 28 is maintained in fluid communication with flow channel 30, but the flow channel 28 is fluidly isolated from the flow channels 32 or 34 to prevent the fluid within passageway 'F' from entering passageway 'E'. Furthermore, the flow channel 32 is maintained in fluid communication with fluid channel 34, but the flow channel 32 is fluidly isolated from the flow channels 28 or 30 to prevent the fluid within passageway 'E' from entering passageway 'F'.

To prevent fluid within passageway 'F' from entering passageway 'E', the ports 'A' and 'D' of plate pair 12(1) are brazed to ports 'C' and 'B' of plate pair 14(1), respectively, and ports 'A' and 'D' of plate pair 12(2) are brazed to ports 'C' and 'B' of plate pair 14(2). To prevent fluid within passageway 'E' from entering passageway 'F', the ports 'D' and 'A' of plate pair 14(1) are brazed to ports and 'B' of plate pair 12(2), respectively, and ports 'D' and 'A' of plate pair 14(2) are brazed to ports 'C' and 'B' of plate pair 12(3), respectively. Additionally, the entire side boundary 46 of the plate pairs 12 and 14 (see FIG. 3) is sealed by brazings to prevent the escapement of fluid at the boundary of the heat exchanger 10.

Figure 2:
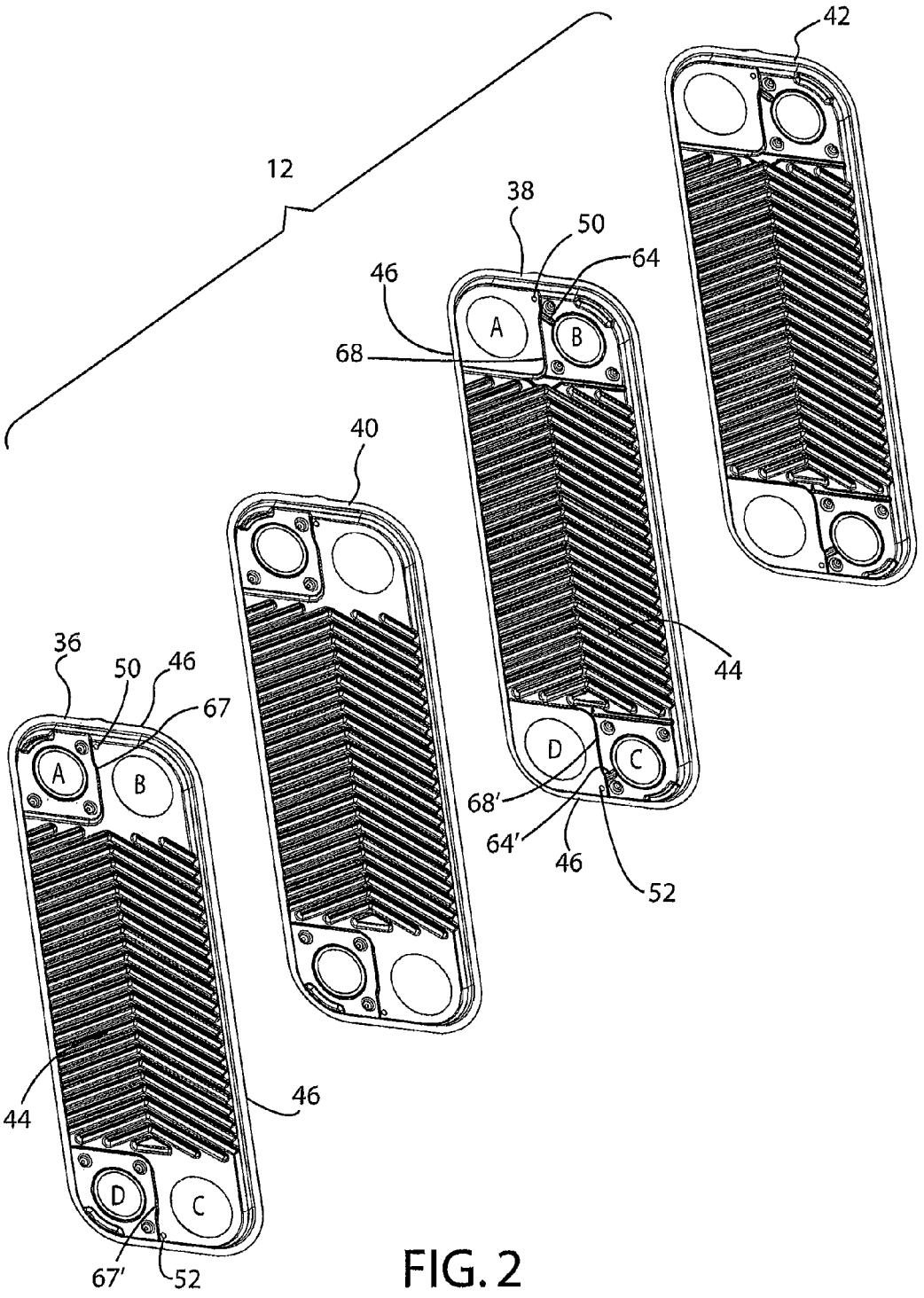
FIG. 2 depicts an exploded perspective view of one plate pair of the heat exchanger of FIG. 1.

FIG. 2 depicts an exploded perspective view of a heat transfer plate pair 12 of the heat exchanger 10. The details of the plate pair 12 that are described hereinafter also apply to the plate pair 14. As stated previously, the plate pairs 12 and 14 are the same, with the exception that the plate pairs 14 are rotated 180 degrees with respect to the plate pairs 12 in an assembled form of the heat exchanger 10.

Each plate pair 12 includes two plates 36 and 38 that are brazed together to form a double-wall structure. The benefits of a double-wall structure are described in the Background Section. The plates 36 and 38 may be formed from stainless steel, for example, or other metallic or polymeric materials. Each plate 36 and 38 is substantially rectangular and includes a centrally-located chevron area 44. The term 'chevron area' will be understood by those of ordinary skill in the art. The chevron area 44 is an undulating surface that promotes heat transfer. The geometry, size, shape and orientation of the chevron area 44 may differ from that shown without departing from the scope or the spirit of the invention.

Copper braze material 40, which is positioned between the plates 36 and 38, is utilized to braze the plates 36 and 38 together. Copper braze material 42, which is positioned on the outer face of the plate 38, is utilized to braze the plate 38 to the plate 36 of an adjacent plate pair (not shown). As best shown in FIGS. 2, 5, 5A and 6, the areas of the plate pairs 12 and 14 which are not brazed by the braze materials 40 and 42 are the chevron area 44, the ports A-D, the weep holes 50 and 52 and the leak passageways which will be described in greater detail hereinafter. Before brazing, a substance is applied to the chevron area 44 of the plate 38 to prevent wetting of the braze material 40 in that area.

Four ports, which are labeled 'A' through 'D', are openings that are defined on the outer corners of the plates 36 and 38. The ports 'A' through 'D' of plate 36 are positioned in alignment with the ports 'A' through 'D' of plate 38 upon assembling and brazing the plate pair 12.

Each plate 36 and 38 includes two weep holes 50 and 52. Weep hole 50 is positioned at the top end of each plate, whereas weep hole 52 is positioned at the bottom end of each plate 36 and 38. The weep holes 50 of the plates 36 and 38 are positioned in alignment upon assembling and brazing the plate pair 12. The weep holes 52 of the plates 36 and 38 are also positioned in alignment upon assembling and brazing the plate pair 12.

Figure 3:
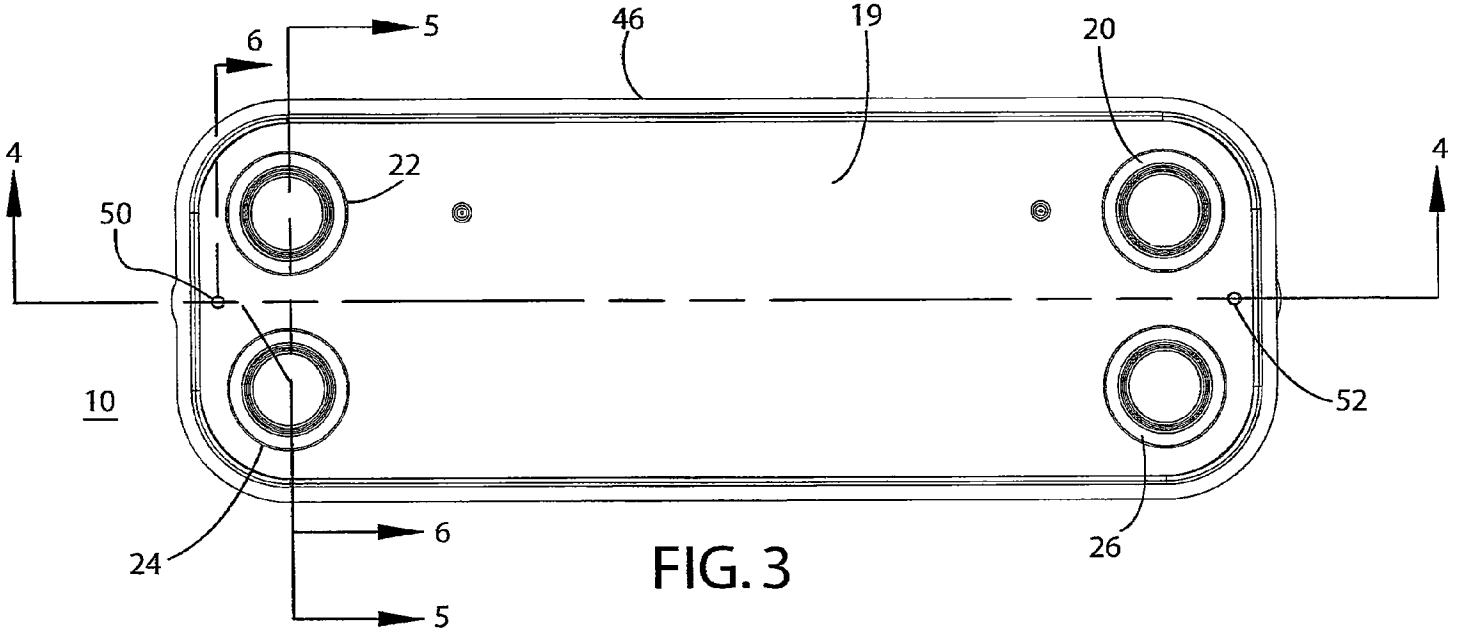
FIG. 3 depicts a front elevation view of the heat exchanger of FIG. 1.

Referring now to FIGS. 1 and 3, upper weep holes 50 and lower weep holes 52 are defined through every plate of the heat exchanger 10. As will be described in greater detail later, the weep holes 50 and 52 are fluidly connected with leak passageways that are defined throughout the interior of the heat exchanger 10 such that any leaking fluid within the leak passage ways is expelled through the weep holes. The weep holes 50 and 52 are optimally defined on the surfaces of the rear plate 15 and the faceplate 19 at locations that are spaced from the side boundary 46 (see FIG. 3) of the heat exchanger 10. Such locations are better suited for visualizing a leaking fluid than a weep hole that is positioned on the boundary edge of a heat exchanger such as that disclosed in Pub. '916, for example.

The heat exchanger 10 includes leak passageways which channel internal leaks that occur within the heat exchanger 10 to the weep holes 50 and 52 of the heat exchanger 10. The leak passageways are fluidly isolated from the fluid passageways 'E' and 'F'. The leak passageways of the heat exchanger 10 comprise an network of channels, pockets and grooves that are interconnected to the weep holes 50 and 52 to channel internal leakages out of the heat exchanger. Further details of the leak passageways are described hereinafter.

Figure 4:
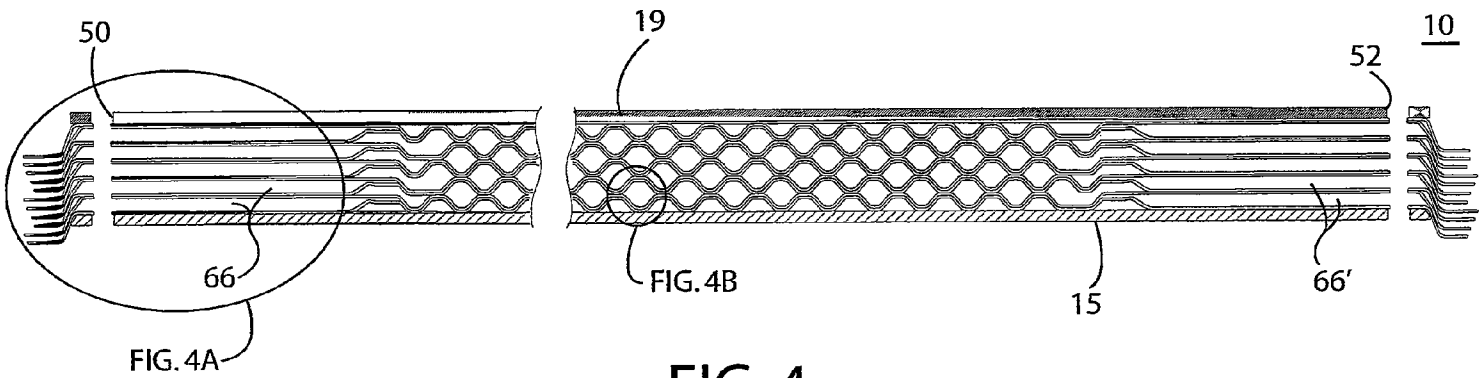
FIG. 4 depicts a truncated cross-sectional side elevation view of the heat exchanger of FIG. 3 taken along the lines 4-4.
Figure 6:
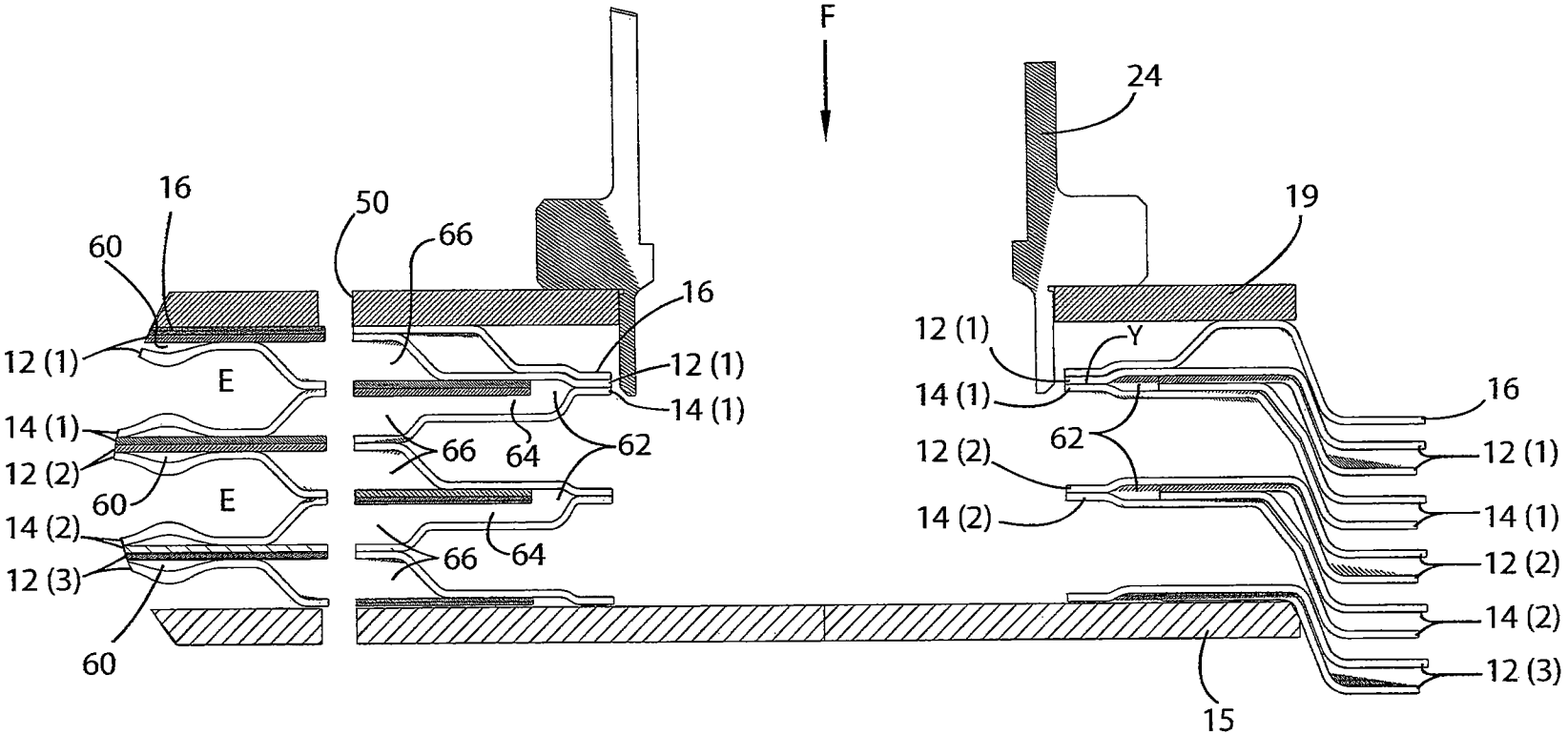
FIG. 6 depicts a cross-sectional side elevation view of the heat exchanger of FIG. 3 taken along the lines 6-6 and rotated 90 degrees counterclockwise.

Referring now to FIGS. 4 and 6, an upper weep hole 50 and a lower weep hole 52 are defined through every plate of the heat exchanger 10. The weep holes 50 and 52 are passages through which leaking fluid within the interior of the heat exchanger 10 is expelled. The upper weep hole 50 intersects an upper central vent pocket 66 that is defined between the plates 36 and 38 of every plate pair 12 and 14. The lower weep hole 52 intersects a lower central vent pocket 66' that is defined between the plates 36 and 38 of every plate pair 12 and 14.

Figure 5A:
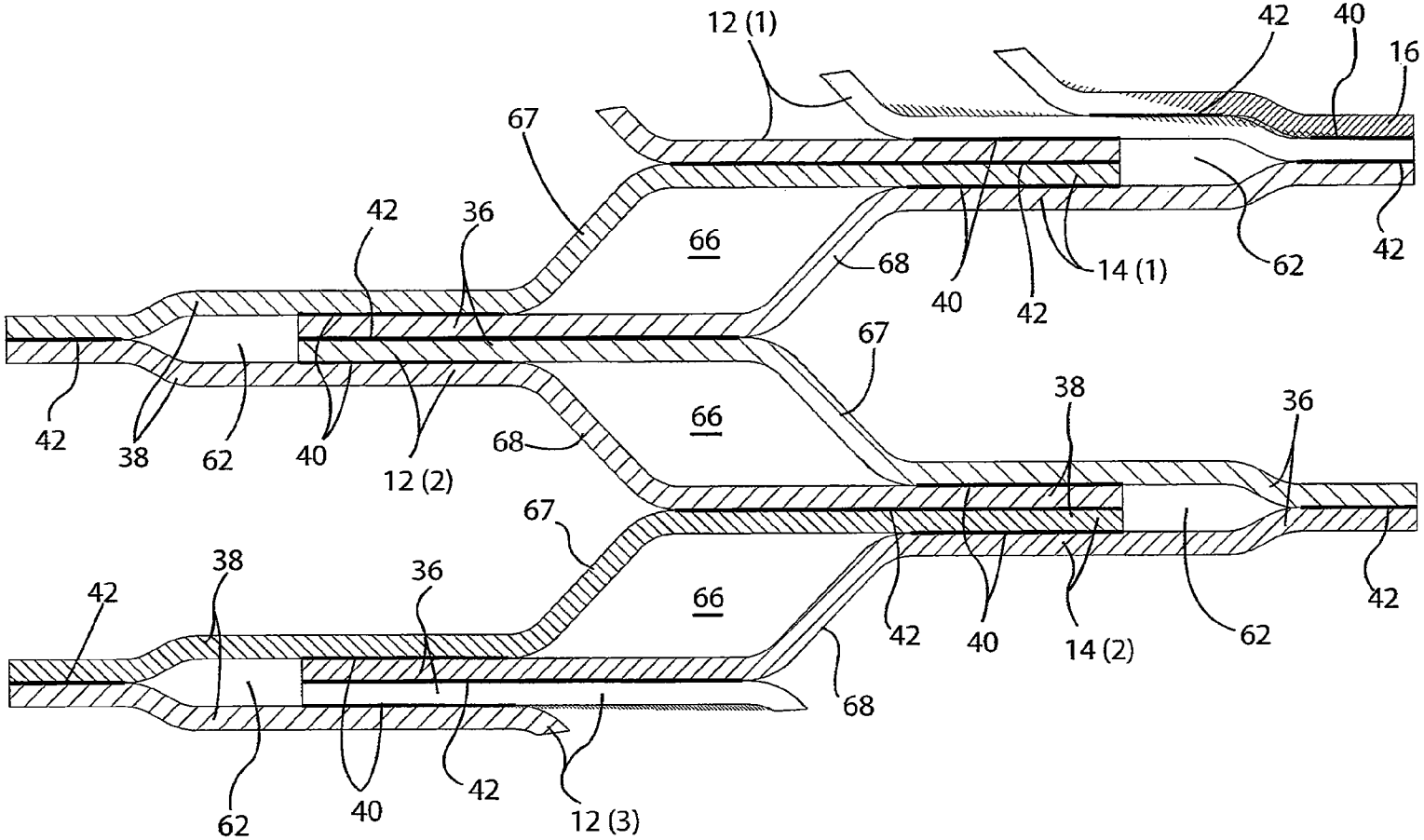
FIG. 5A depicts a detailed view of the heat exchanger of FIG. 5.

Referring now to FIGS. 2, 4, 5, 5A and 6, two central vent pockets 66 and 66' are formed between the plates 36 and 38 of every plate pair 12 and 14. Specifically, as shown in FIGS. 2, 5 and 5A, an upper central vent pocket 66 is a narrow channel that is formed between a wall 67 of plate 36 and a wall 68 of plate 38. As shown in FIG. 4, each upper central vent pocket 66 extends between the chevron area 44 of the plates and the upper weep hole 50 of every plate pair 12 and 14. Each upper central vent pocket 66 intersects a leak space 60 that is defined between chevron areas 44 of the plates 36 and 38 (see FIG. 4) of a plate pair. Each upper central vent pocket 66 also intersects an upper port leak groove 64 that is defined between the plates 36 and 38 of a plate pair, as shown in FIG. 6 (also note the intersection of groove 64 and wall 68 of plate 38 in FIG. 2).

As shown in FIGS. 5 and 5A, the lower central vent pocket 66' is a narrow channel that is formed between a lower wall 67' of plate 36 and a lower wall 68' of plate 38 of each plate pair. As shown in FIG. 4, the lower central vent pocket 66' extends between the chevron area 44 of the plates and the lower weep hole 52. The lower central vent pocket 66' intersects a leak space 60 that is defined between the chevron areas 44 of the plates 36 and 38 (see FIG. 4) of a plate pair. The lower central vent pocket 66' also intersects a lower port leak groove 64' of a plate pair (note the intersection of groove 64' and wall 68' of plate 38 in FIG. 2).

Figure 4A:
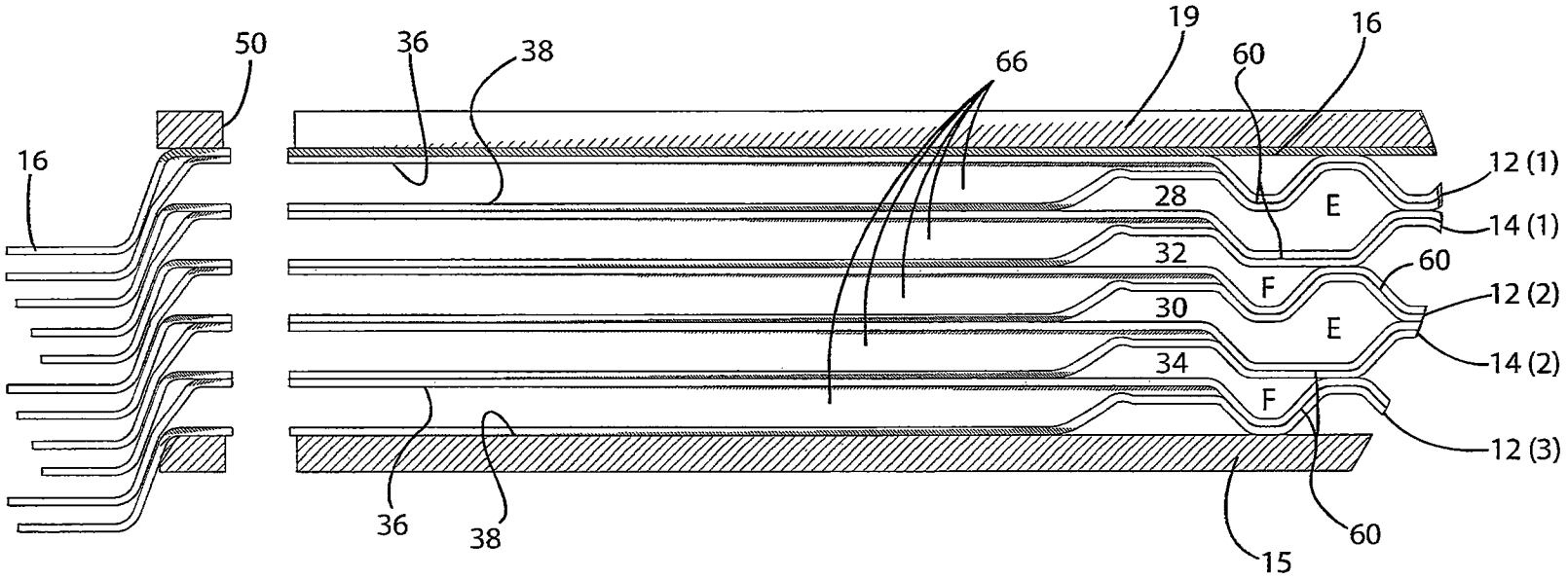
FIGS. 4A and 4B depict detailed views of the heat exchanger of FIG. 4.
Figure 4B:
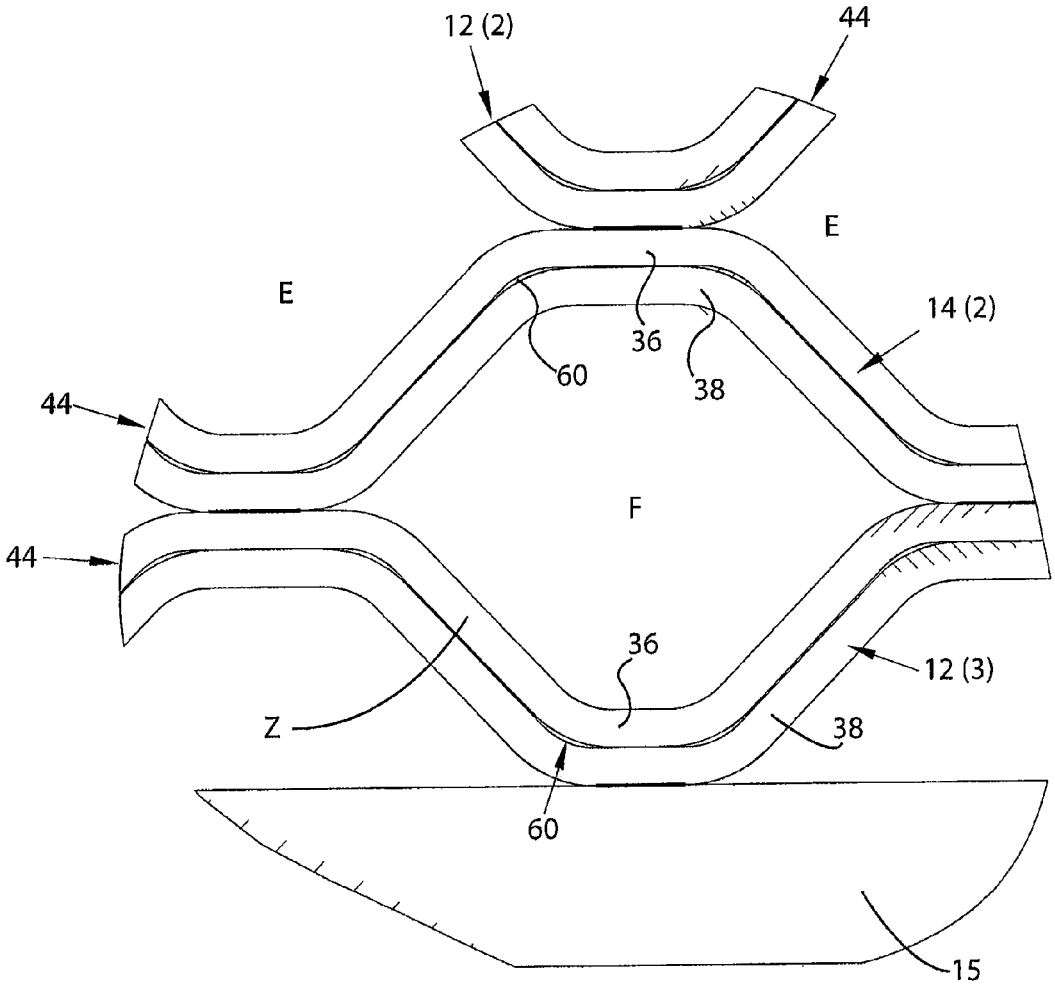

Referring now to FIGS. 4A and 4B, a leak space 60 is defined between chevron areas 40 of the plates 36 and 38 of each plate pair. The leak spaces 60 may be non-continuous, as shown in FIG. 4B, along the chevron areas 44 of the plates 36 and 38. The leak spaces 60 intersect two central vent pockets 66 and 66' that are formed between the plates 36 and 38 of each plate pair 12 and 14.

Referring now to FIGS. 2 and 6, two port leak grooves 64 and 64' are formed between the plates 36 and 38 of each plate pair. The upper port leak groove 64 of each plate pair is a substantially straight and narrow channel that extends between an upper central vent pocket 66 and a port vent groove 62 that surrounds port 'B'. The lower port leak groove 64' of each plate pair is a substantially straight and narrow channel that extends between a lower central vent pocket 66' and a port vent groove 62 that surrounds port 'C'.

Referring now to FIGS. 5 and 5A, each port vent groove 62 is an annular channel that is defined at a location surrounding the brazed ports of adjacent plate pairs 12 and 14. More particularly, each port vent groove 62 surrounds an annular brazing there the ports of adjacent plate pairs 12 and 14 are sandwiched together. In operation, upon failure of a brazed joint at one of the ports, leaking fluid collects in the port vent groove 62 that extends from that failed brazed joint. A port vent groove 62 surrounds the following port brazings: the brazing between port 'A' of plate pair 12(1) and port 'C' of plate pair 14(1); the brazing between port 'D' of plate pair 12(1) and port 'B' of plate pair 14(1); the brazing between port 'D' of plate pair 14(1) and port 'B' of plate pair 12(2); the brazing between port 'A' of plate pair 14(1) and port 'C' of plate pair 12(2); the brazing between port 'A' of plate pair 12(2) and port 'C' of plate pair 14(2); the brazing between port 'D' of plate pair 12(2) and port 'B' of plate pair 14(2); the brazing between port 'D' of plate pair 14(2) and port 'B' of plate pair 12(3); and the brazing between port 'A' of plate pair 14(2) and port 'C' of plate pair 12(3).

As noted previously, the leak spaces 60, port vent grooves 62, port leak grooves 64/64' central vent pockets 66/66', and weep holes 50/52 of the leak passageway are all interconnected together to channel a leaking fluid out of the interior of the heat exchanger through the weep holes 50 and/or 52. In summary, the weep holes 50 and 52 intersect central vent pockets 66 and 66', respectively, that are defined directly between the plates of every plate pair 12 and 14. The central vent pockets 66 and 66' intersect leak spaces 60 that are defined directly between the chevron areas 44 of the plates of every plate pair. The central vent pockets 66 and 66' also intersect port leak grooves 64 and 64', respectively, that are defined directly between the plates of every plate pair. The port leak grooves 64 and 64' intersect port vent grooves 62 that are defined directly between adjacent plate pairs 12 and 14 at a location surrounding where the brazed ports of adjacent plate pairs 12 and 14. Leaking fluid can travel from a port vent groove 62 to port leak grooves 64/64', then to central vent pockets 66/66', and then to the weep holes 50/52. Leaking fluid can also travel from a leak space 60 to central vent pockets 66/66', and then to the weep holes 50/52

For example, if the brazing 42 at location 'Y' (see FIG. 6) fails, then the fluid in passageway 'F' will migrate through the failed brazing 42 and into the port vent groove 62 at the intersection of plate pairs 12(1) and 14(1). The leaking fluid will fill the annular channel defined by port vent groove 62 and travel into the port leak groove 64 of plate pair 14(1) that intersects the port vent groove 62. The leaking fluid will then travel into the central vent pocket 66 of the plate pair 14(1) that intersects the port leak groove 64. The leaking fluid will then travel into the weep hole 50 that intersects the central vent pocket 66 of the plate pair 14(1). The leaking fluid will ultimately exit out of the weep hole 50 at the front and rear surfaces of the heat exchanger 10 at a location that is spaced from the side boundary 46 of the heat exchanger 10.

As another example, if a hole or crack were to form at location 'Z' (see FIG. 4B) of the chevron area 44 of the plate 36 of plate pair 12(3), then the fluid within fluid passageway 'F' will leak through the crack and enter the leak space 60 that is defined between plates 36 and 38 of plate pair 12(3). The double-wall construction of the heat exchanger 10 will prevent the leaking fluid of the fluid passageway 'F' from mixing with the fluid within the fluid passageway 'E'. The leaking fluid will then migrate by capillary action through the leak space 60 of the plate pair 12(3) and enter the central vent pockets 66 and 66' (see FIG. 4A) of plate pair 12(3). The leaking fluid will then travel into the weep hole 50 that intersects the central vent pocket 66 of the plate pair 14(1), and/or travel into the weep hole 52 that intersects the central vent pocket 66' of the plate pair 14(1). The leaking fluid will ultimately exit out of the weep holes 50 and/or 52 at the front and rear surfaces of the heat exchanger 10 at a location that is spaced from the side boundary 46 of the heat exchanger 10.

Although the invention is illustrated and described herein with reference to specific embodiments, the invention is not intended to be limited to the details shown. Rather, various modifications may be made in the details within the scope and range of equivalents of the claims and without departing from the invention. For example, the number of flow channels and plate pairs may vary from that shown and described.

What is claimed:

1. A double-wall heat exchanger comprising:

a plurality of heat exchange plate pairs that are mounted to a faceplate fluid connectors attached to the faceplate through which first and second heat exchange fluids are distributed into dedicated fluid flow channels defined between adjacent plate pairs and out of the heat exchanger;

each heat exchange plate pair forming a double-wall structure comprising two heat exchange plates that are separated by a leak space having a depth, the leak space extending across an entire chevron area of the plates and is fluidly isolated from the fluid flow channels;

two weep holes that are disposed through the plurality of heat exchange plate pairs, each weep hole passing through each heat exchange plate and the faceplate at a location that is interior the outer circumferential boundary of each heat exchange plate and the faceplate, the two weep holes located adjacent opposite sides of the heat exchanger;

two central vent pockets vertically extending between the heat exchange plates of each plate pair, each central vent pocket longitudinally extending between the chevron area and one of the weep holes, thus directly connection each chevron area with one of the weep holes, the leak spaces transitioning into the central vent pockets as follows: by vertically widening to a first constant depth and then maintaining the first constant depth for a first length, then by vertically widening to a second constant depth and then maintaining the second constant depth for a second length, the second depth being deeper than the first depth, the first depth being deeper than the depth of the leak spaces;

a port vent groove that annularly surrounds each brazed port of every adjacent plate pair such that the port vent groove is located between said one of the plate pairs and an adjacent heat exchange plate pair;

two port leak grooves defined between the heat exchange plates of each plate pair, each port lead groove being a straight fluid channel, each port leak groove intersects one of the central vent pockets at a single point and intersects one of the port vent grooves at a single point;

each weep hole passing straight from the faceplate through one central vent pocket of each plate pair, in the plate pairs, the weep holes only intersecting the central vent pockets and the faceplate.

2. The double-wall heat exchanger of claim 1, wherein each weep hole is defined on either a front facing surface or a rear facing surface of the heat exchanger.

3. The double-wail heat exchanger of claim 1, wherein the side boundary of the heat exchanger is sealed to prevent escapement of fluid at the side boundary.

4. The double-wail heat exchanger of claim 1, wherein adjacent fluid channels are fluidly isolated from each other.

5. The double-wall heat exchanger of claim 1, wherein alternating fluid channels are in fluid communication with each other.

6. The double-wall heat exchanger of claim 1, wherein the chevron area includes a series of undulations to facilitate heat transfer.

7. The double-wall heat exchanger of claim 1 further comprising at least one fluid port defined through each plate pair within which the heat exchange fluid is distributed either into or out of a fluid channel that is defined between adjacent plate pairs, wherein two adjacent plate pairs are mated together at a boundary of the at least one fluid port.

8. The double-wall heat exchanger of claim 7, wherein the at least one fluid port is fluidly isolated from the weep holes.

9. The double-wall heat exchanger of claim 1, wherein the leak spaces are respectively formed between the plates of each plate pair.

10. The double-wall heat exchanger of claim 1, wherein for each plate of a plate pair, one side of the plate is exposed to one of the leak spaces, and the other side of the plate is exposed to one of the fluid flow channels.

11. The double-wail heat exchanger of claim 6, wherein the leak space of each heat exchange plate pair is defined between the undulations of the heat exchange plates.

* * * * *